US009615654B2

(12) United States Patent
Grace

(10) Patent No.: US 9,615,654 B2
(45) Date of Patent: Apr. 11, 2017

(54) SLIMFOLD TABLE

(71) Applicant: Daniel R. Grace, Old Saybrook, CT (US)

(72) Inventor: Daniel R. Grace, Old Saybrook, CT (US)

(73) Assignee: GCI Outdoor, Inc., Higganum, CT (US)

( * ) Notice: Subject to any disclaimer, the term of this patent is extended or adjusted under 35 U.S.C. 154(b) by 0 days.

(21) Appl. No.: 14/806,223

(22) Filed: Jul. 22, 2015

(65) Prior Publication Data

US 2016/0022027 A1 Jan. 28, 2016

Related U.S. Application Data

(60) Provisional application No. 62/027,457, filed on Jul. 22, 2014.

(51) Int. Cl.

| | |
|---|---|
| ***A47B 1/04*** | (2006.01) |
| ***A47B 3/087*** | (2006.01) |
| ***A47B 3/00*** | (2006.01) |
| *A47B 3/083* | (2006.01) |

(52) U.S. Cl.

CPC ..... *A47B 3/087* (2013.01); *A47B 3/002* (2013.01); *A47B 2003/0835* (2013.01)

(58) Field of Classification Search

CPC ..... A47B 3/00; A47B 3/083; A47B 3/087; A47B 3/002; A47B 2003/0835; A47B 2001/005; A47B 1/04; A47B 96/025

USPC ..... 108/115, 77, 162, 164, 118

See application file for complete search history.

(56) References Cited

U.S. PATENT DOCUMENTS

| | | | | | |
|---|---|---|---|---|---|
| 236,741 | A | | 1/1881 | Weaver | |
| 1,165,991 | A | | 12/1915 | Maggs | |
| 1,858,857 | A | * | 5/1932 | Huntley | A47B 1/04 108/101 |
| 2,154,125 | A | * | 4/1939 | Dillon | A47B 1/04 108/79 |
| 2,197,286 | A | * | 4/1940 | Zieman | A47B 3/0918 108/115 |
| 2,578,922 | A | * | 12/1951 | Cramer | A47B 1/04 108/82 |
| 2,579,934 | A | | 12/1951 | Krasney | |
| 2,594,262 | A | * | 4/1952 | Howe | A47B 3/087 108/167 |
| 2,730,418 | A | | 1/1956 | Blink | |
| 2,837,141 | A | | 6/1958 | Shore | |

(Continued)

*Primary Examiner* — Jose V Chen

(74) *Attorney, Agent, or Firm* — McCormick, Paulding & Huber LLP

(57) ABSTRACT

A slimfold table has a plurality of legs, at least one table leaf, an inner cross brace, and an outer cross brace. The plurality of legs, the at least one table leaf, the inner cross brace, and the outer cross brace are movable from a deployed condition to a nested condition. The deployed condition has the plurality of legs all generally parallel each other and spaced apart by the inner and outer cross braces, with the at least one table leaf generally orthogonal the legs. The nested condition has the plurality of legs all generally parallel and adjacent to each other and to the inner and outer cross braces and to the at least one table leaf, with the legs and the at least one table leaf nested within the inner cross brace and the inner cross brace nested within the outer cross brace.

19 Claims, 7 Drawing Sheets

(56) References Cited

U.S. PATENT DOCUMENTS

| | | | | | |
|---|---|---|---|---|---|
| 3,202,438 | A * | 8/1965 | Panknin | A21B 3/00 | 280/42 |
| 3,415,208 | A * | 12/1968 | Thoresen | A47B 3/00 | 108/104 |
| 3,436,092 | A * | 4/1969 | Werner | A47B 31/04 | 108/115 |
| 3,731,971 | A | 5/1973 | Sjogren | | |
| 4,415,199 | A | 11/1983 | Wright | | |
| 5,131,547 | A * | 7/1992 | Goldberg | A47F 5/13 | 108/166 |
| 5,255,724 | A * | 10/1993 | Butke | B23Q 1/74 | 108/33 |
| 5,642,898 | A * | 7/1997 | Wise | B25H 1/04 | 280/47.19 |
| 5,794,546 | A * | 8/1998 | Carter | A47B 3/12 | 108/115 |
| 5,806,864 | A * | 9/1998 | Zielinski | B62B 3/02 | 280/42 |
| 6,349,962 | B1 * | 2/2002 | Johanson | B62B 3/02 | 280/42 |
| D491,709 | S * | 6/2004 | Wise | D34/18 | |
| 7,168,372 | B2 * | 1/2007 | Fotia | A47B 3/002 | 108/77 |
| D555,871 | S * | 11/2007 | Pong | D34/17 | |
| D608,969 | S * | 1/2010 | Wise | D34/12 | |
| RE41,763 | E * | 9/2010 | Ng | A47B 43/00 | 108/115 |
| 8,201,550 | B2 * | 6/2012 | Malumyan | A47J 37/0704 | 108/109 |
| 2002/0096845 | A1 * | 7/2002 | Spann | A61G 12/001 | 280/79.2 |
| 2009/0000522 | A1 * | 1/2009 | Collins | B25H 1/04 | 108/12 |

* cited by examiner

SLIMFOLD TABLE

CROSS REFERENCE TO RELATED APPLICATIONS

This application claims priority to U.S. Pat. App. 62/027,457, "Slimfold Cook Station," filed Jul. 22, 2014.

BACKGROUND

Technical Field

The present invention relates to portable furniture, especially folding furniture. Aspects of the invention relate to folding tables, such as cook stations.

Discussion of Art

Folding furniture has been known. Folding tables in particular have been known. However, it is continually desirable to provide folding furniture—in particular, folding tables—that are of lighter weight, easier to carry, and with enhanced functional options.

SUMMARY OF INVENTION

In some embodiments of the invention, a cook station is provided as a slimfold table, i.e., one that can be folded substantially flat by comparison to bulkier prior art folding tables. One aspect of the invention is that legs of the slimfold table fold laterally outside the edges of central leaves of the slimfold table, such that in the folded condition, the folded legs surround the edges of the table leaves. Another aspect of the invention is that cross braces of the slimfold table fold laterally outside the legs of the slimfold table. Thus, the leaves, the legs, and the cross braces are laterally nested in their folded positions. This permits collapsing the table to a relatively small volume for transport or storage, by comparison to bulkier conventional folding tables.

In certain embodiments, the central leaves provide a heat-resistant folding counter top. In certain embodiments, the central leaves include latching means for supporting a load at least as heavy as a portable grill. In certain embodiments, the slimfold cook station is provided with side leaves as well as central leaves. In certain embodiments, the side leaves include edge receptacles that can be used in a variety of purposes due to their unique shapes. For example, the edge receptacles can receive any of wine glasses, table glasses, grill tools, a strap for holding rolled paper towels, or handles of a bag.

Certain exemplary embodiments of the invention, as briefly described above, are illustrated by the following figures.

DETAILED DESCRIPTION

Figure 1:
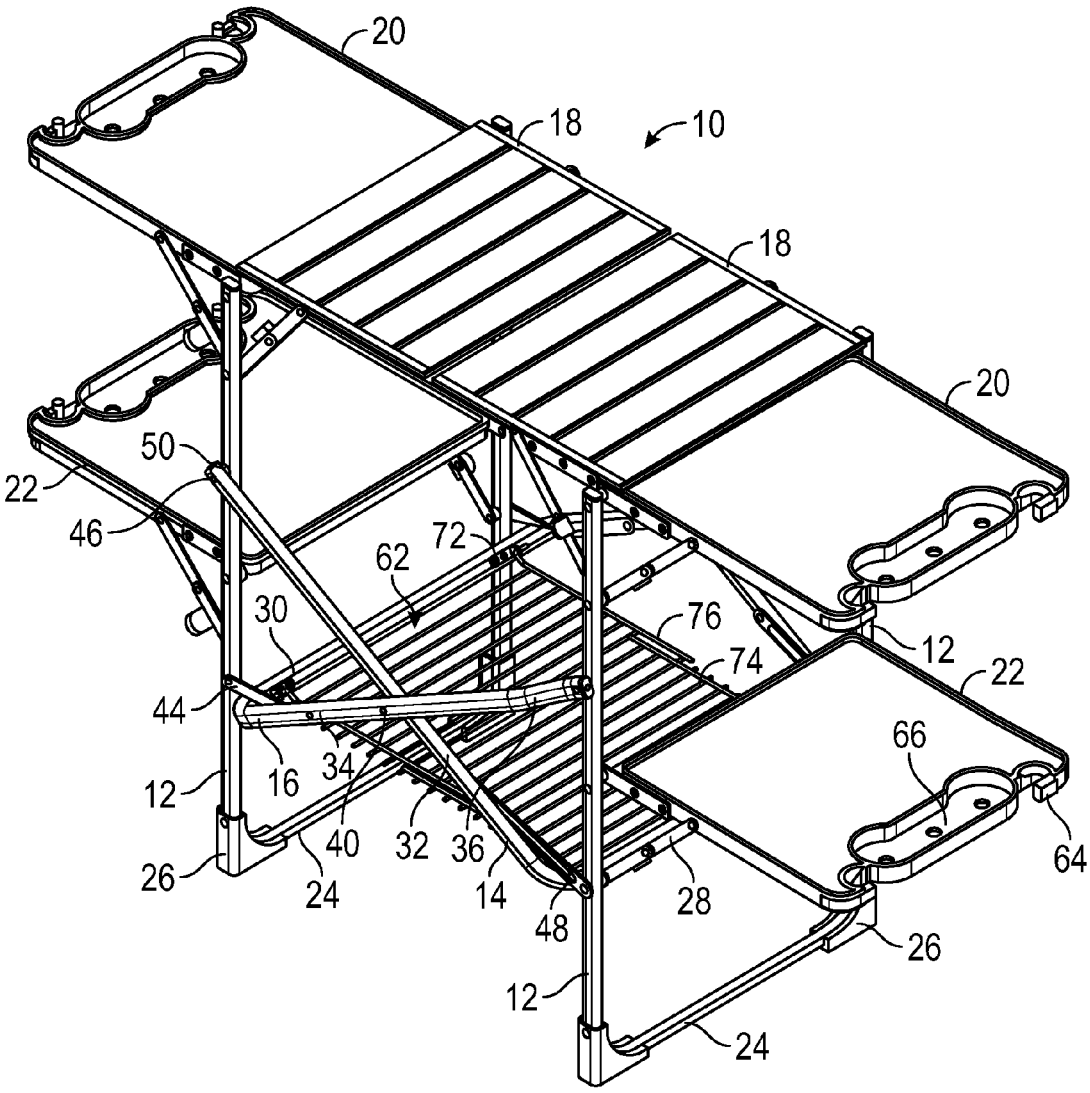
FIG. 1 shows in front perspective partly assembled view a slimfold table in a setup condition according to an embodiment of the invention.
Figure 2:
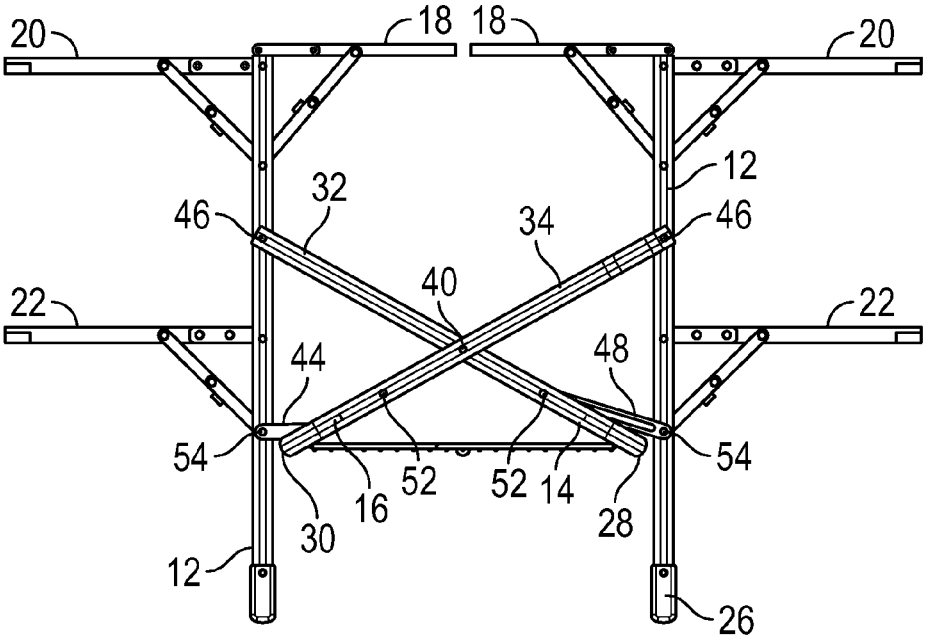
FIG. 2 shows in front elevation view the slimfold table of FIG. 1.

FIG. 1 shows in front perspective view a folding furnishing, e.g., a slimfold table 10, which includes first and second pairs of legs 12 that are pivotally connected by an inner cross brace 14 and an outer cross brace 16. The legs 12 support a plurality of table leaves, specifically, inner leaves 18 as well as upper 20 and lower 22 side leaves.

Each of the pairs of legs 12 is connected by foot members 24 at their bottom ends, thereby forming U-shaped pairs of legs. Corner pieces 26 are mounted at the junctures of the upright legs 12 with the foot members 24. The corner pieces provide stability against rocking motions of the legs in their setup positions. The paired legs, however, need not be U-shaped. For example, each leg instead could be a straight piece 12 terminating at a foot member 24, with a pair of legs at each end of the table, the paired legs being connected by a cross brace in an H-shape. Connecting the legs in pairs, generally, enhances ease of use of the folding furnishing.

Each of the cross braces is U-shaped, thus, a cross brace, and has first and second side members that are joined by a cross member. The U-shapes of the cross braces permit of folding the legs and cross braces into a nested condition with the cross braces substantially surrounding the legs, as further discussed below.

Figure 4:
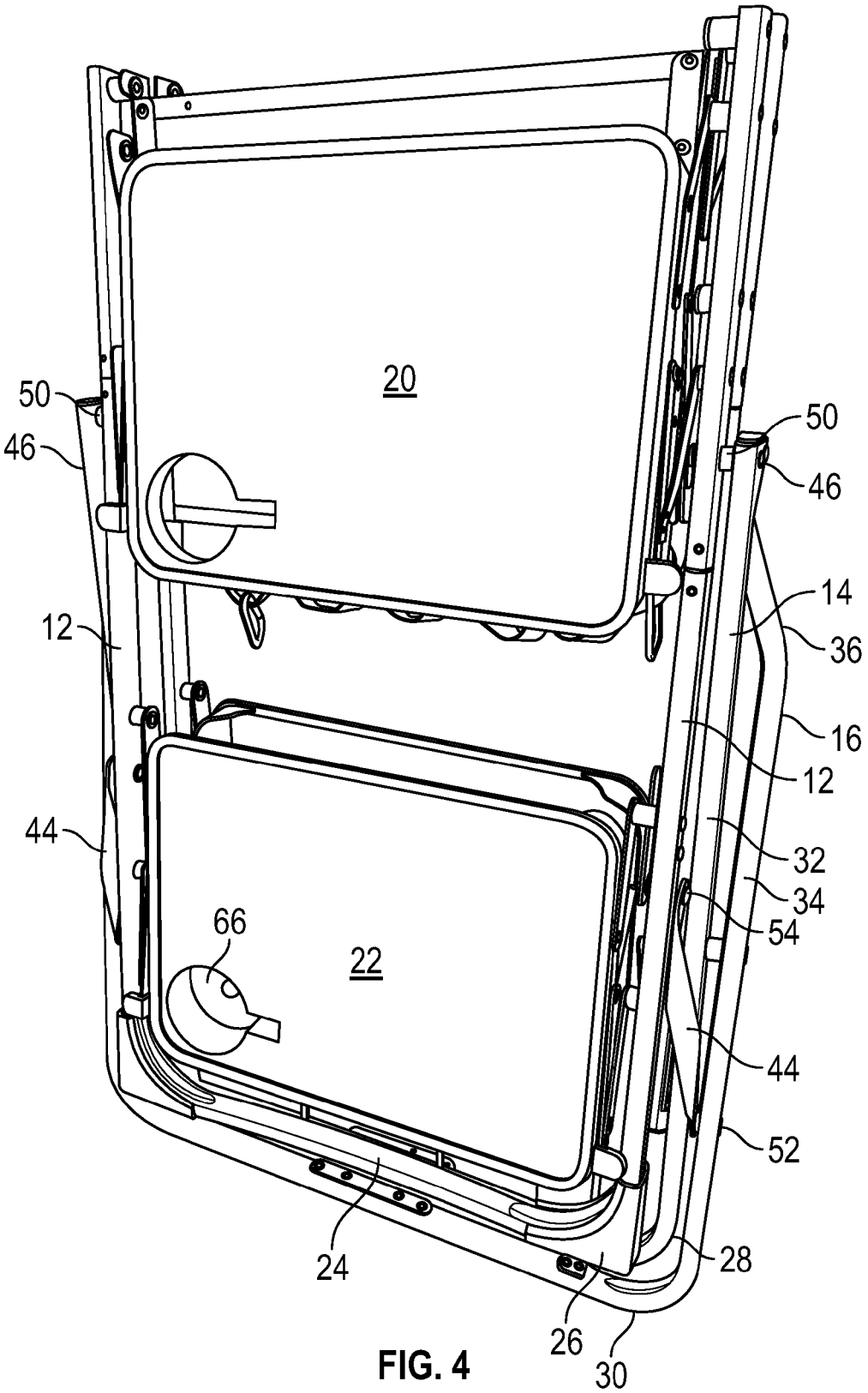
FIG. 4 shows in perspective view a fully folded condition of the slimfold table of FIGS. 1-3.

The legs and the cross braces are fastened together by pivoting joints, so that they can be mutually moved among a deployed or setup condition as shown in FIG. 1, or a collapsed or nested condition as shown in FIG. 4, or any intermediate positions.

Referring to the inner cross brace 14, its cross member 28 is of a first length that is shorter than the cross member 30 of the outer cross brace 16. The side members 32 of the inner cross brace are generally flat and straight. By contrast, the cross member 30 of the outer cross brace is of a second length that is longer than the cross member 28 of the inner cross brace, and the side members 34 of the outer cross brace have crooked ends 36, so that the side members 32 of the inner cross brace are generally laterally nested within the side members 34 of the outer cross brace while the respective ends of the inner and outer cross brace side members are connected to the respective uprights 12.

The cross braces are pivotally connected to each other by center pins 40 (e.g., rivets or shoulder bolts), which are positioned at about the midpoints of the side members 32, 34. Between the inner and outer cross braces, the center pins 40 carry center bushings, which space apart the side members of the cross braces to permit nested folding. In particular, the center bushings position the inner cross brace 14 with respect to twisted links 44 that connect the outer cross brace 16 with the legs 12. This positioning of the inner cross brace 14 permits it to fold at least partly into the twisted links 44, as further described below and as shown in FIG. 4.

The side members 32 of the inner cross brace 14 are pivotally connected to the first pair of the legs 12 by top pins 46 at their top ends, and are pivotally connected to the second pair of the legs 12 by flat links 48 near the cross member 28. The top pins 46 carry top bushings 50 between the cross brace side members 32 and the first pair of legs 12, thereby spacing the side members of the inner cross brace 14 apart from the first pair of legs 12 so as to admit space for folding the twisted links 44 that are further described below. The flat links 48 are pivotally connected to the side members of the inner cross brace by link pins 52, and are pivotally connected to the second pair of legs by bottom pins 54.

Figure 7:
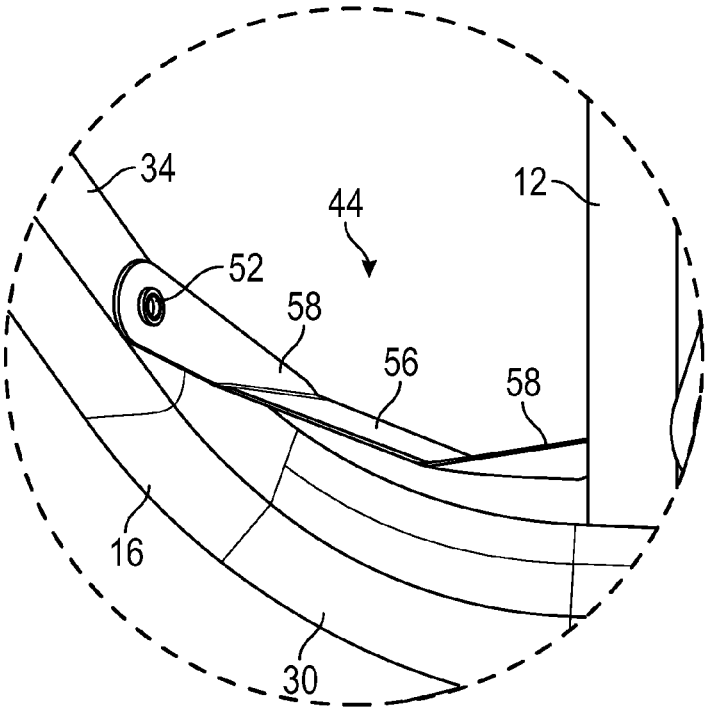
FIG. 7 shows in perspective view a detail of a twisted cross brace link of the slimfold table of FIGS. 1-5.

The outer cross brace 16 is pivotally connected to the second pair of legs 12 by top pins 46 at its crooked ends 36, and is pivotally connected to the first pair of legs 12 by the aforementioned twisted links 44. Referring to detail FIG. 7, each of the twisted links 44 includes a flat body 56 with two arms 58 protruding symmetrically upward from sides of the flat body. One arm 58 of each twisted link is pivotally connected to one of the side members 34 of the outer cross brace by a link pin 52, while the other arm of each twisted link is pivotally connected to one of the uprights of the first pair of legs by a bottom pin 54. The twisted links 44 bridge across a lateral gap that exists between the outer cross brace side members 34 and the first pair of legs 12, in order to permit the nesting of the inner 14 and outer cross braces 16 as described above. In order to nest the side members 32 of the inner cross brace 14 into the twisted links 44, the center bushings 42 position the inner cross brace side members in registry with the flat bodies 56 of the twisted links, i.e., between the arms 58 of the twisted links. Thus, when the legs 12 are collapsed toward each other, the side members 32 of the inner cross brace 14 fold into the twisted links and are nested laterally between the side members 34 of the outer cross brace.

Figure 8:
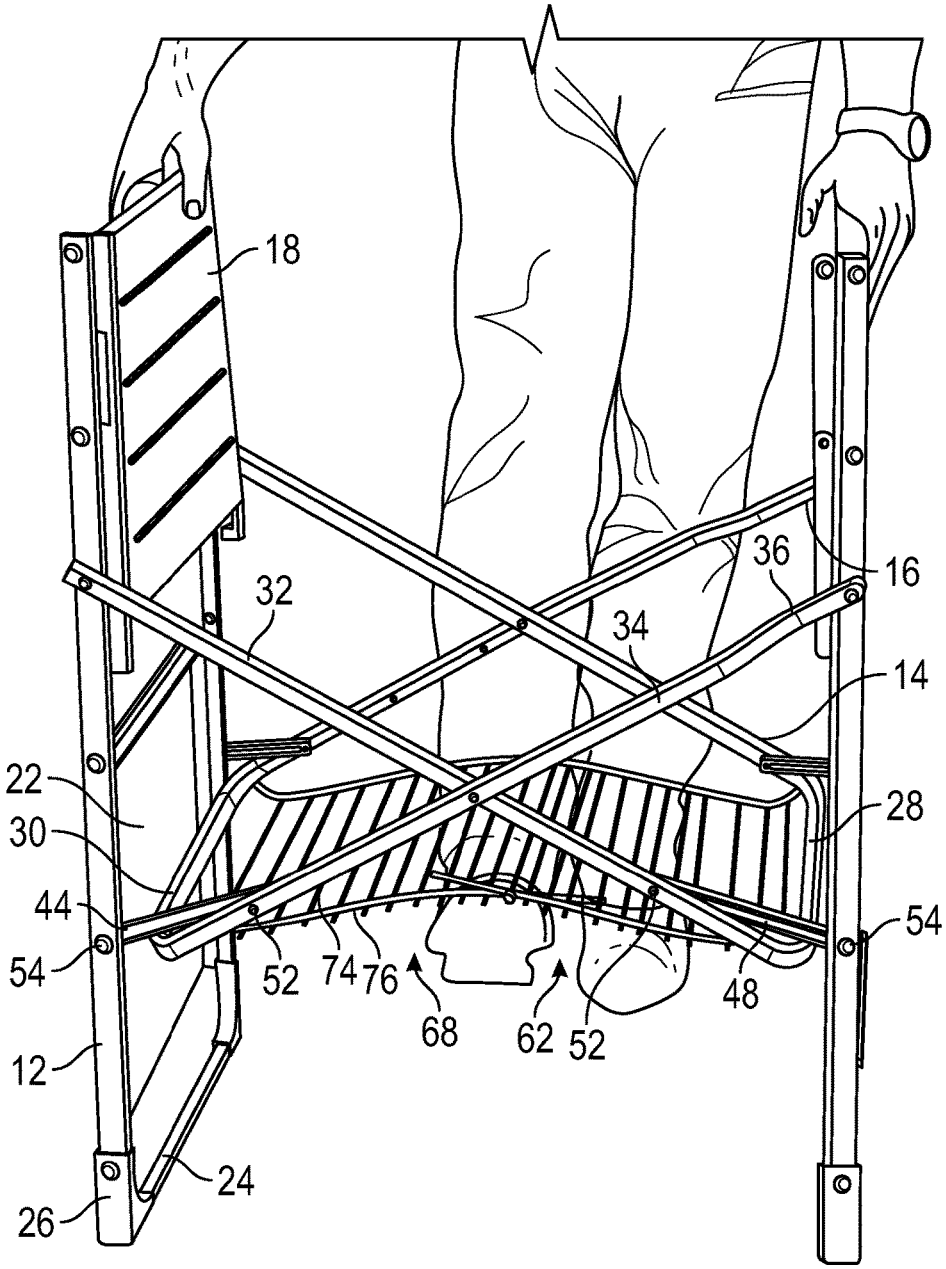
FIG. 8 shows in perspective view a mode of folding the slimfold table of FIGS. 1-5.
Figure 9:
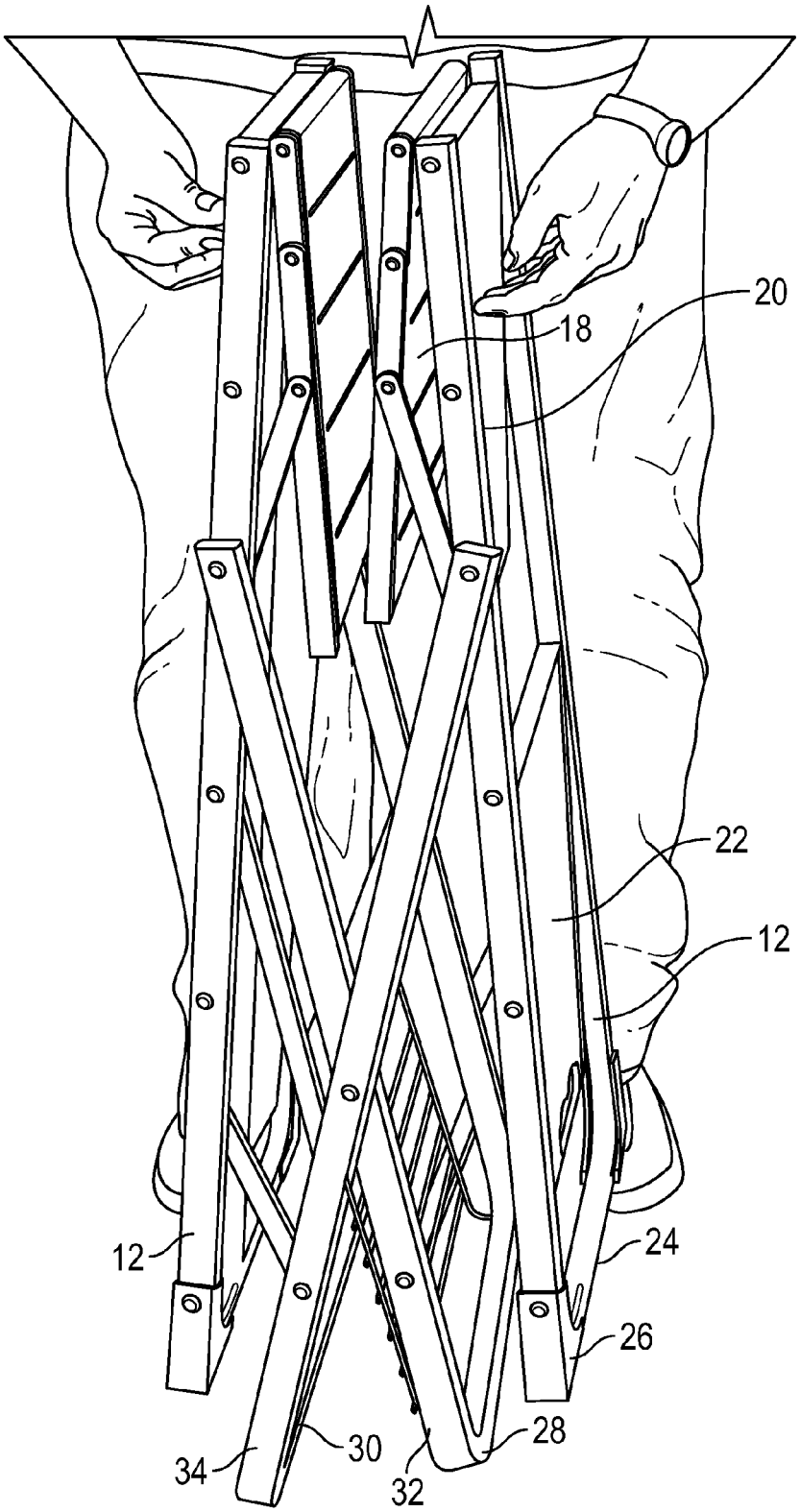
FIG. 9 shows in perspective view a partly folded condition of the slimfold table of FIGS. 1-5.

In order to provide for nesting of the legs 12 within the inner 14 and outer 16 cross braces, the link pins 52 are positioned between the center pins 40 and the respective cross members 28 or 30 of the cross braces 14 or 16, at a distance from the cross members so that a total folding distance F from the bottom pins 54 to the link pins 52 and back to the cross members 28 or 30 exceeds a linear distance L from the bottom pins 54 to the corner pieces 26. Thus, when the legs are collapsed together as shown in FIGS. 8 and 9, the links 44, 48 shift the cross braces 14, 16 downward relative to the legs 12, so that the legs can nest within the cross braces as shown in FIG. 4.

In order to prevent excess movement of the legs 12 when nested within the cross braces 14, 16, a locator peg 59 is provided at an inward surface of one of the inner cross brace side members 32.

For carriage of the slimfold table 10 in its collapsed condition, a handle 60 is provided on one of the side members of the outer cross brace.

The slimfold table 10, of course, does not consist only of the legs and the cross braces. In order to serve its primary purpose of being a table, the slimfold table includes inner leaves 18, upper side leaves 20, lower side leaves 22, and a wire rack 62.

Figure 5:
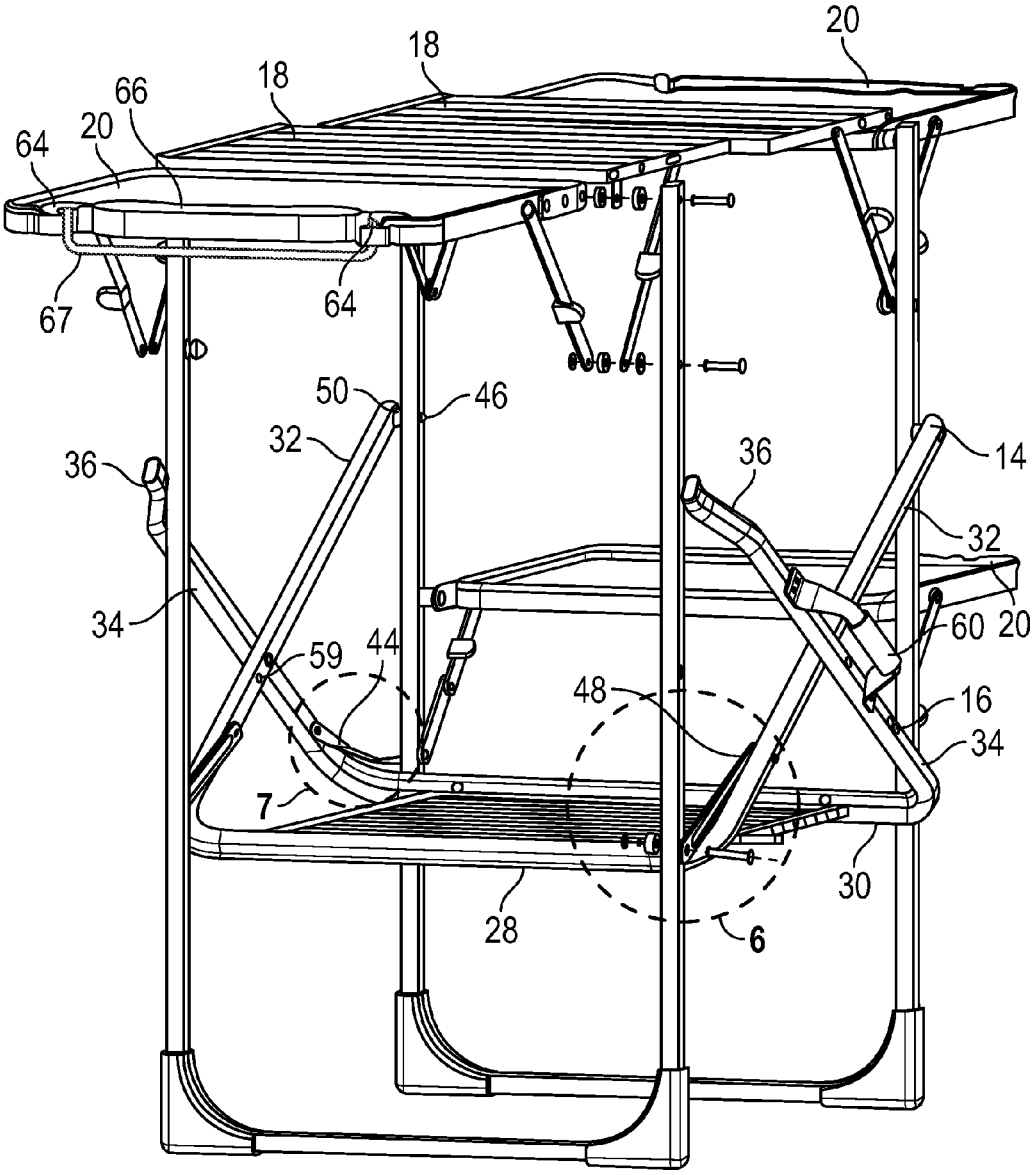
FIG. 5 shows in rear perspective view the slimfold table of FIGS. 1-2 in a setup condition.
Figure 6:
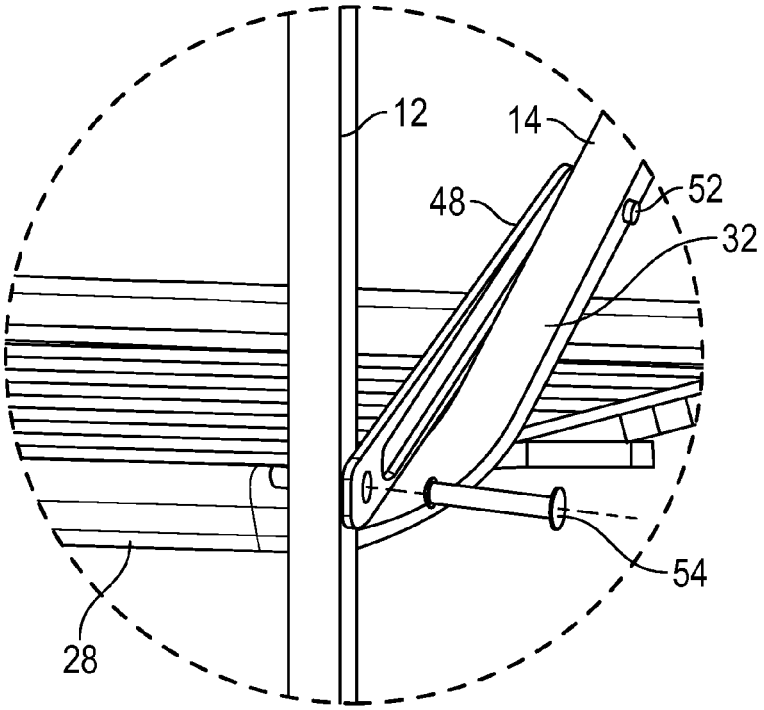
FIG. 6 shows in perspective view a detail of a flat cross brace link of the slimfold table of FIGS. 1-5.

The leaves of the slimfold table are collapsibly mounted onto the uprights of the legs 12 by conventional overcenter links. The inner leaves 18 preferably are fabricated of one or more heat resistant materials, e.g., enameled metal. At their adjacent mating edges, the inner leaves 18 can include one or more interlocking features, e.g., a tongue or tongues protruding from the underside of one or both of the inner leaves 18 to engage against the underside of the other inner leaf. The side leaves 20, 22 may be heat resistant, or may be lightweight polymers, or may be a heat resistant polymer such as silicone. Each of the side leaves 20, 22 includes hooks 64 and wells 66 for holding drinksware. The hooks also can hold straps, e.g., for a paper towel roll strap 67 as shown in FIG. 5.

The wire rack 62 includes two grates 68, which are pivotally connected with the cross members 28, 30 of the inner 14 and outer 16 cross braces, e.g., by hooking toes 70 of the grates into brackets 72 fastened to the cross members, as shown in FIG. 1. Alternatively, the grates 68 can be hooked into holes formed in the cross members 28, 30, as shown in FIG. 8. In any case, the grates 68 are movable between a deployed condition in which they extend horizontally toward each other between the cross braces, or a folded condition in which they extend generally parallel to and within the cross braces 14, 16. The grates 68 are disposed laterally within the side members 32, 34 so that the grates do not interfere with collapsing movement of the cross braces 14, 16. Each grate has cross bars 74 that are fastened to fingers 76. The fingers 76 of each grate 68 overlap the cross bars 74 of the other grate, so that the grates in their deployed positions interlock to provide rigidity of the wire rack. However, when the legs of the table are collapsed together, the grates can unlock and fold upward toward the legs so that in the nested or collapsed condition of the table the grates lay parallel and adjacent each other. In certain embodiments, the inwardmost cross bars of the two grates can be loosely fastened to each other, e.g., by a ring or the like, so as to maintain the interlocked arrangement of the fingers even when the grates are folded upward toward the legs.

Figure 3:
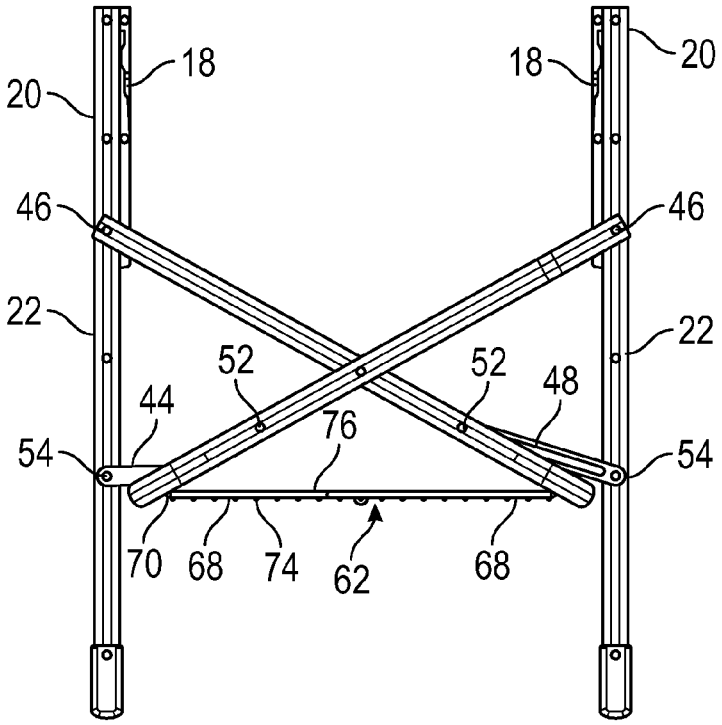
FIG. 3 shows in front elevation view a partly folded condition of the slimfold table of FIGS. 1-2.

Thus, the slimfold table 10 can be collapsed from its deployed condition, as shown in FIG. 1, to its folded condition, as shown in FIG. 4. In particular, the table leaves 18, 20, 22 first are folded down against the legs 12, as shown in FIG. 3. Then, as shown in FIGS. 8-9, a user unlocks the wire rack 62 while lifting and collapsing together the legs 12. Lifting and collapsing movement of the legs 12 causes the cross braces 14, 16 to pivot and nest as described above and as shown in FIG. 4.

Although exemplary embodiments of the invention have been described with reference to attached drawings, those skilled in the art nevertheless will apprehend variations in form or detail that are consistent with the scope of the invention as defined by the appended claims.

What is claimed is:

1. A slimfold table comprising:

a plurality of legs;

at least one table leaf pivotally connected to at least one of the plurality of legs;

an inner cross brace pivotally connected with each of the plurality of legs; and an outer cross brace pivotally connected with each of the plurality of legs, and with the inner cross brace;

wherein the plurality of legs, the at least one table leaf, the inner cross brace, and the outer cross brace are movable from a deployed condition to a nested condition, wherein the deployed condition has the plurality of legs all generally parallel each other and spaced apart by the inner and outer cross braces, with the at least one table leaf generally orthogonal the legs, wherein the nested condition has the plurality of legs all generally parallel and adjacent to each other and to the inner and outer cross braces and to the at least one table leaf, with the legs and the at least one table leaf nested within the inner cross brace and the inner cross brace nested within the outer cross brace, such that at least a portion of the table leaf, the inner cross brace and the outer cross brace are positioned in a common plane, the common plane being generally parallel to the legs, and further wherein said common plane includes the at least one of the plurality of legs to which the at least one table leaf is connected.

2. The slimfold table as claimed in claim 1, further comprising:

a pair of center pins coaxially arranged at opposite sides of the outer cross brace and pivotally connecting the outer cross brace to the inner cross brace;

a pair of center bushings carried on the center pins between the inner and outer cross braces and spacing the inner cross brace apart from the outer cross brace.

3. The slimfold table as claimed in claim 1, further comprising:

a pair of flat links pivotally connected between the inner cross brace and a first pair of the plurality of legs; and a pair of twisted links pivotally connected between the outer cross brace and a second pair of the plurality of legs, wherein the nested condition has the inner cross brace folded at least partly into the twisted links.

4. The slimfold table as claimed in claim 3, wherein the flat links are pivotally connected to the inner cross brace by link pins and to the first pair of the plurality of legs by bottom pins, and a total folded distance from the bottom pins to the link pins along the flat links and from the link pins to a cross member of the inner cross brace is greater than a linear distance from the bottom pins to lower ends of the first pair of the plurality of legs.

5. The slimfold table as claimed in claim 3, wherein the twisted links are pivotally connected to the outer cross brace by link pins and to the first pair of the plurality of legs by bottom pins, and a total folded distance from the bottom pins to the link pins along the twisted links and from the link pins to a cross member of the outer cross brace is greater than a linear distance from the bottom pins along the uprights to lower ends of the second pair of the plurality of legs.

6. The slimfold table as claimed in claim 1, wherein each of the legs includes an upright and a foot connected at a bottom end of the upright, wherein the feet of the first pair of the plurality of legs directly contact and connect with each other, and the feet of the second pair of the plurality of legs directly contact and connect with each other.

7. The slimfold table as claimed in claim 1, wherein the at least one table leaf comprises inner leaves pivotally connected at top ends of at least some of the plurality of legs, and movable from collapsed positions generally adjacent and along their respective legs, to deployed positions protruding generally orthogonal to their respective legs and toward each other.

8. The slimfold table as claimed in claim 1, wherein the at least one table leaf comprises side leaves pivotally connected at top ends of at least some of the plurality of legs, and movable from collapsed positions generally adjacent and along their respective legs, to deployed positions protruding generally orthogonal to their respective legs and away from each other.

9. The slimfold table as claimed in claim 1, wherein the at least one table leaf comprises lower side leaves pivotally connected at middle portions of at least some of the plurality of legs, and movable from collapsed positions generally adjacent and along their respective legs, to deployed positions protruding generally orthogonal to their respective legs and away from each other.

10. The slimfold table as claimed in claim 1 wherein the outer cross brace has its ends spaced apart from the respective legs.

11. The slimfold table as claimed in claim 1, further comprising a wire rack pivotally mounted at lower portions of the inner and outer cross braces.

12. The slimfold table as claimed in claim 11, wherein the wire rack comprises a first grate pivotally mounted at a lower portion of the inner cross brace, and a second grate pivotally mounted at a lower portion of the outer cross brace, wherein the first grate and the second grate interlock to provide the wire rack in a substantially flat condition when the slimfold table is in its deployed condition, and fold upward toward the legs when the slimfold table is in its nested condition.

13. The slimfold table as claimed in claim 1, wherein the inner cross brace is substantially U-shaped with a cross member connecting first and second side members, the outer cross brace is substantially U-shaped with a cross member connecting first and second side members, and the inner and outer cross braces are pivotally connected by first and second center pins extending coaxially through midpoints of the respective first and second side members.

14. The slimfold table as claimed in claim 13, wherein a first pair of the plurality of legs are connected at their lower ends to form a first U-leg and a second pair of the plurality of legs are connected at their lower ends to form a second U-leg, wherein the inner cross brace is connected to the first U-leg by top pins through upper ends of its first and second side members, and is connected to the second U-leg by flat links pinned to lower ends of said first and second side members, wherein the outer cross brace is connected to the second U-leg by top pins through upper ends of its first and second side members, and is connected to the first U-leg by twisted links pinned to lower ends of said first and second side members, wherein the center pins carry center bushings between the side members of the inner and outer cross braces, and the center bushings position the side members of the inner cross brace in registry between arms of the twisted links, so that when the slimfold table is moved to its nested condition, the side members of the inner cross brace fold between the arms of the twisted links.

15. The slimfold table as claimed in claim 14, wherein the flat links are pivotally connected to the inner cross brace by link pins and to the second U-leg by bottom pins, and a total folded distance from the bottom pins to the link pins along the flat links and from the link pins to the cross member of the inner cross brace is greater than a linear distance from the bottom pins to the lower end of the second U-leg, wherein the twisted links are pivotally connected to the outer cross brace by link pins and to the first U-leg by bottom pins, and a total folded distance from the bottom pins to the link pins along the twisted links and from the link pins to the cross member of the outer cross brace is greater than a linear distance from the bottom pins to the lower end of the first U-leg.

16. A folding furnishing comprising:

a plurality of legs each comprising at least one upright and a foot connected at a bottom end of the upright;

an inner cross brace pivotally connected with each of the plurality of legs;

an outer cross brace pivotally connected with each of the plurality of legs, and with the inner cross brace;

a pair of flat links pivotally connected between the inner cross brace and a first pair of the plurality of legs; and a pair of twisted links pivotally connected between the outer cross brace and a second pair of the plurality of legs, wherein the plurality of legs, the inner cross brace, and the outer cross brace are movable from a deployed condition to a nested condition, wherein the deployed condition has the plurality of legs all generally parallel each other and spaced apart by the inner and outer cross braces, wherein the nested condition has the plurality of legs all generally parallel and adjacent to each other and to the inner and outer cross braces, with the legs nested within the inner cross brace and the inner cross brace nested within the outer cross brace, the inner cross brace folded at least partly into the twisted links such that at least a portion of the inner cross brace and the outer cross brace are positioned in a common plane, the common plane being generally parallel to the legs.

17. The folding furnishing as claimed in claim 16, wherein the flat links are pivotally connected to the inner cross brace by link pins and to the first pair of the plurality of legs by bottom pins, and a total folded distance from the bottom pins to the link pins along the flat links and from the link pins to the cross member of the inner cross brace is greater than a linear distance from the bottom pins along the uprights to the feet of the first pair of the plurality of legs, wherein the twisted links are pivotally connected to the outer cross brace by link pins and to the second pair of the plurality of legs by bottom pins, and a total folded distance from the bottom pins to the link pins along the twisted links and from the link pins to the cross member of the outer cross brace is greater than a linear distance from the bottom pins along the uprights to the feet of the second pair of the plurality of legs.

18. The folding furnishing as claimed in claim 16, wherein the inner cross brace is substantially U-shaped with a cross member connecting first and second side members, the outer cross brace is substantially U-shaped with a cross member connecting first and second side members, and the inner and outer cross braces are pivotally connected by first and second center pins extending coaxially through midpoints of the respective first and second side members.

19. A slimfold table comprising:

a plurality of legs including a first pair of legs and a second pair of legs;

a common plane defined by the first pair of legs;

at least one table leaf pivotally connected to the first pair of legs;

an inner cross brace pivotally connected with the first pair of legs; and an outer cross brace pivotally connected with the second pair of legs, and further pivotally connected with the inner cross brace by at least two axially aligned center pivot pins;

wherein the plurality of legs, the at least one table leaf, the inner cross brace, and the outer cross brace are movable from a deployed condition to a nested condition, wherein the deployed condition has the plurality of legs all generally parallel each other and spaced apart by the inner and outer cross braces, with the at least one table leaf generally orthogonal the legs, wherein the nested condition has the plurality of legs all generally parallel and adjacent to each other and to the inner and outer cross braces and to the at least one table leaf, with the legs and the at least one table leaf nested within the inner cross brace and the inner cross brace nested within the outer cross brace, such that at least a portion of the at least one table leaf, the inner cross brace and the outer cross brace are positioned in the common plane.

* * * * *